US005181835A

United States Patent [19]

Cook

[11] Patent Number: 5,181,835

[45] Date of Patent: Jan. 26, 1993

[54] HYDRAULIC PUMP

[75] Inventor: Gregory D. Cook, Duncan, Okla.

[73] Assignee: Cook Manufacturing Corporation, Duncan, Okla.

[21] Appl. No.: 700,516

[22] Filed: May 15, 1991

[51] Int. Cl.[5] ..... F04B 49/00; F04B 37/00; F04B 7/02

[52] U.S. Cl. ..... 417/310; 417/315; 417/507

[58] Field of Search ..... 417/310, 315, 442, 446, 417/507; 418/15

[56] References Cited

U.S. PATENT DOCUMENTS 3,529,617 9/1970 Huber ..... 417/15
4,339,233 7/1982 Krueger ..... 417/507
4,824,332 4/1989 Perkins et al. ..... 17/315

*Primary Examiner*—Richard A. Bertsch
*Assistant Examiner*—Alfred Basichas
*Attorney, Agent, or Firm*—Bill D. McCarthy; Glen M. Burdick; Louis W. Watson

[57] ABSTRACT

A hydraulic pump having a pump body formed by stacked plates mounted end-to-end. First and second ports for delivery and return of hydraulic fluid are formed through a port plate that is surmounted by a valve plate through which first and second main valve passages, each aligned with the first and second ports respectively, are formed. The valve plate is surmounted by a manifold plate in which first and second fluid distribution chambers, fluidly communicated with the first and second main valve passages respectively, are formed. A pump plate atop the manifold plate contains a gear assembly in a pumping chamber formed in the ends of the pump and manifold plates that draws fluid from one fluid distribution chamber and discharges it to the other. Each main valve passage contains a main pump valve that is biased for movement toward a sealing position that blocks fluid flow from through the main valve passage and each main pump valve is engaged by pistons in piston chambers that intersect the main valve passage in which the valve is disposed and opens to the fluid distribution chamber communicated with the other main valve passage.

7 Claims, 6 Drawing Sheets

HYDRAULIC PUMP

BACKGROUND OF THE INVENTION

1. Field of the Invention

The present invention relates to improvements in hydraulic pumps.

2. Brief Description of the Prior Art

Hydraulic pumps and actuating cylinders provide an effective means for positioning an object with respect to its surroundings and are, accordingly, in widespread use. For example, as disclosed in U.S. Pat. No. 4,482,330 issued Nov. 13, 1984 to Cook, there are advantages to adjusting the height of an outboard motor on the transom of a boat during operation of the boat and such positioning can be efficiently carried out by mounting the motor on a motor bracket that is slidably mounted on a transom bracket that is, in turn, mounted on the transom of the boat. Vertical movement of the motor can then be effected by a hydraulic actuating cylinder that is connected between the two brackets and operated by pressurized hydraulic fluid supplied by a hydraulic pump.

U.S. Pat. No. 4,482,330 provides an illustration of demands that are often made on hydraulic pumps. In order for the pump used in the motor mounting apparatus described in U.S. Pat. No. 4,482,330 to carry out the purpose intended, it must meet a number of requirements. Not only must the pump be reversible (that is, capable of delivering hydraulic fluid under pressure from either of two ports while receiving return fluid into the other port), it must also provide a positive seal against fluid flow once the motor has been placed at a desired position. Moreover, these requirements must be reliably met by a pump of reasonable size that can be mounted on the transom bracket. Of equal importance, these characteristics must be met by a pump that can be obtained at a reasonable cost from a dependable source of supply. Since the outboard motor mounting apparatus is a consumer item, excessively expensive components will limit the market for the apparatus; similarly, if the source is not dependable, difficulties will arise in meeting the demand to again affect the market for the product.

In the past, the totality of these requirements has created a problem for the manufacturer of a product in which a hydraulic pump would be well suited for carrying out the operation of the product. The manufacturer may not be able to obtain a suitable pump at a price that will make its product competitive, or low cost pumps that are available may not be well suited for its product. Moreover, the manufacturer may very well not be in a position to manufacture the pumps itself to meet its requirements. If the product is a specialty item, the cost of tooling up to manufacture the pump (primarily the cost of casting pump bodies to include various chambers and flow passages) may not be recoverable from sales of the product. The net result is that the manufacturer may have to use a pump that is not optimally suited for its product but that is available at a reasonable price. Moreover, should the source of pumps dry up, for example, by a discontinuance of manufacture of the pump, the manufacturer must find a new source of supply, requiring a compromise between pump characteristics and pump costs. In the worst case, the manufacturer may not be able to find a suitable pump at a suitable price.

SUMMARY OF THE INVENTION

The present invention provides a hydraulic pump that can be economically manufactured in small lots to a pump user's specifications. To these ends, the hydraulic pump of the present invention is comprised of a pump body that, in turn, is comprised of a plurality of stacked plates that can be manufactured using nothing but machine tools found in any machine shop and then connected end-to-end to form the pump body. Chambers and flow passages that contain operating elements of the pump that control the movement of fluid into and out of the pump body as well as movement therein are formed, for the chambers, in the ends of the plates and, for the passages, through the plates so that the pump can be manufactured using nothing more than standard turning, milling and drilling operations that can be carried out at low cost in any machine shop. Thus, in particular, costly casting operations, which have made the manufacture of prior art pumps in small lots economically unfeasible, are eliminated in the manufacture of pumps constructed in accordance with the present invention.

Such construction is, in part, enabled by a novel valving assembly of which the pump of the present invention is comprised. More specifically, control of fluid flow to and from the pump and sealing of the pump against fluid flow when the pump is not operating is effected by two main pump valves that are located in main valve passages that communicate with ports that deliver hydraulic fluid from the pump and receive the return of fluid to the pump. These valves are biased for movement to sealing positions in the main valve passages so that fluid flow into the pump is prevented at such times that the pump is not operating to deliver and receive hydraulic fluid from and to the pump. During operation, hydraulic fluid is transferred between two fluid distribution chambers, each of which is fluidly communicated with a main valve passage, so that pressure in one fluid distribution chamber will force one main pump valve open to permit delivery of hydraulic fluid from the pump. The return of fluid to the pump is then effected by a piston assembly that responds to fluid pressure in the fluid distribution chamber to which hydraulic fluid is transferred and mechanically engages the main pump valve in fluid communication with the other fluid distribution chamber to force such main pump valve away from the sealing position thereof and open the main valve passage wherein such valve is located to fluid flow.

An object of the present invention is to provide a hydraulic pump that can be economically manufactured in small lots.

Another object of the invention is to provide a low cost hydraulic pump that will enable manufacturers of products wherein pumps are used to manufacture the pumps used in their products.

Yet a further object of the invention is to provide a hydraulic pump that can be inexpensively manufactured using machine tools and without the use of castings.

Other objects, features and advantages of the present invention will become apparent from the following detailed description when read in conjunction with the drawings and appended claims.

DESCRIPTION OF THE PREFERRED EMBODIMENT

Figure 1:
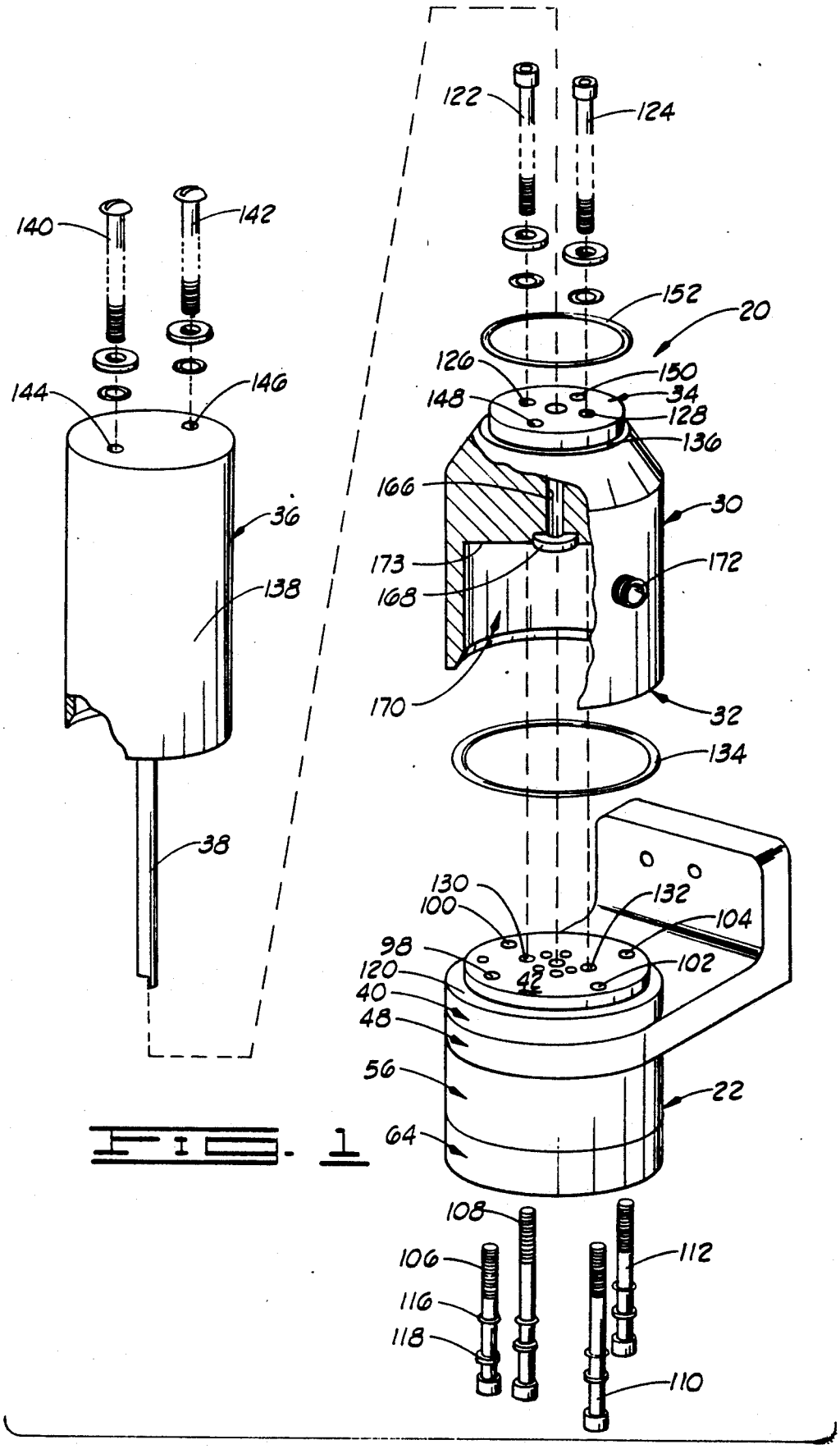
FIG. 1 is an exploded, partially cutaway view of a hydraulic pump constructed in accordance with the present invention.

Referring now to the drawings in general and to FIG. 1 in particular, shown therein and designated by the general reference number 20 is a hydraulic pump constructed in accordance with the present invention. In general, the pump 20 is comprised of a pump body 22 that has first and second ports 24, 26 (FIG. 12) formed therein for delivering hydraulic fluid to an external device (not shown) such as a hydraulic actuating cylinder and receiving a return of fluid therefrom. A gear assembly 28 (FIG. 4), forming a conventional gear pump, is mounted within the pump body 22 to draw fluid from a selected one of the ports and discharge it, under pressure, to the other port as will be described below. Atop the pump body 22, the pump 20 is comprised of a reservoir member 30 that has an open lower end 32 (also referred to herein as a second end 32 of the reservoir member) and a closed upper, or first, end 34. The interior of the reservoir member forms a reservoir for hydraulic fluid that can be used to provide additional fluid to the discharge from the pump 20 or receive a portion of the fluid returned to the pump 20 in a manner to be described below. A reversible electric motor 36 is mounted atop the reservoir member 30 and has an elongated shaft 38 that extends through the reservoir member 30 when the pump is assembled and into the pump body 22 to engage and drive the gear assembly 28.

Figure 2:
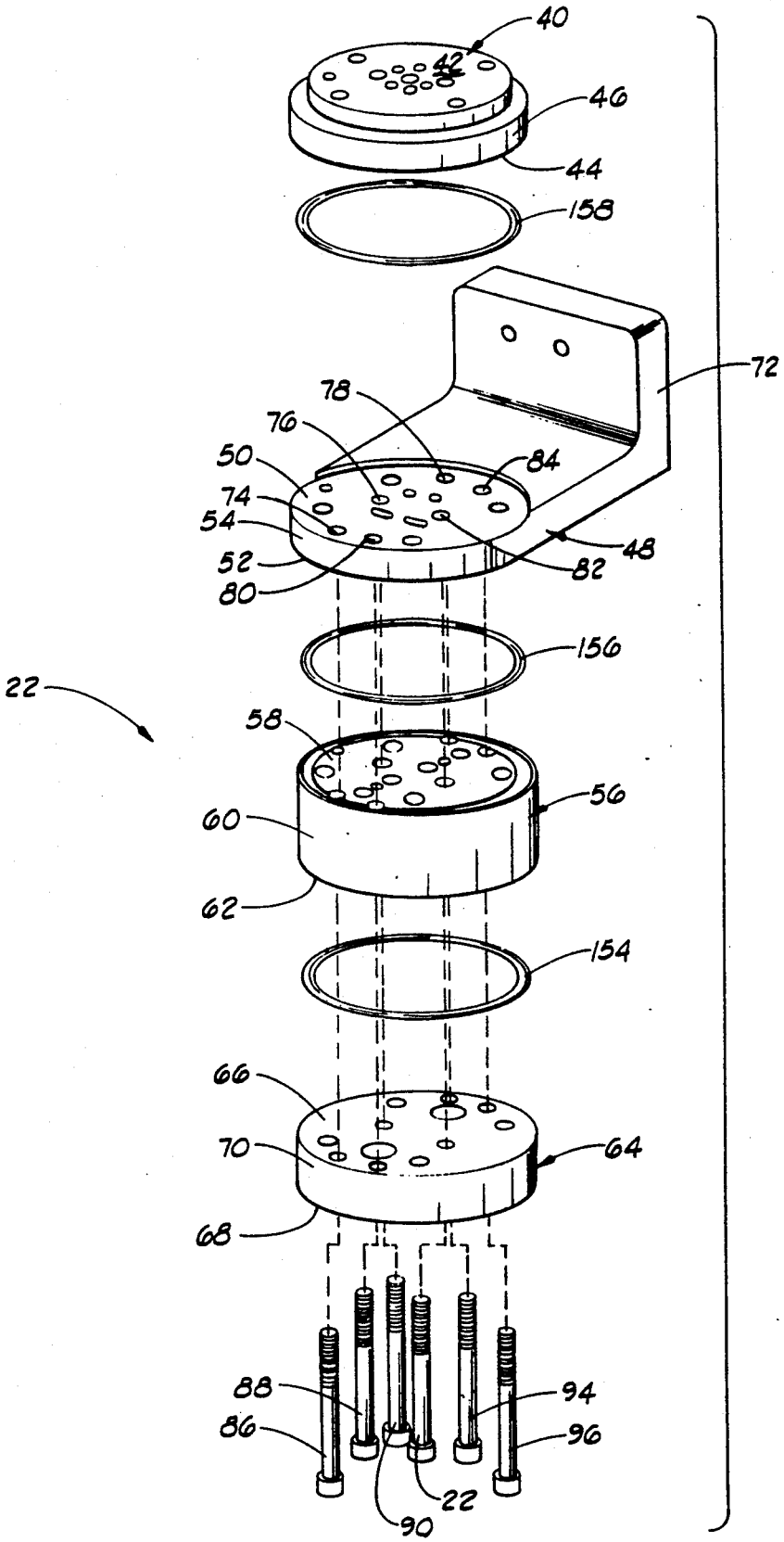
FIG. 2 is an exploded view of the pump body of the pump shown in FIG. 1.

In accordance with one aspect of the present invention, the construction of the pump body 22 and reservoir 30 are such that the pump 20 can be economically manufactured using machine tools that are available in any machine shop and FIGS. 1 and 2 illustrate in part the manner in which this construction is achieved. As shown in FIG. 2, the pump body 22 is comprised of a stack of plates that can be bolted end-to-end so that manufacture of the pump body 22 can be readily effected by manufacturing the plates and then assembling the pump body 22 from them. More specifically, the pump body 22 is comprised of: a pump plate 40 having a first end 42, a second end 44 and an outer periphery 46 that intersects the ends 42, 44 and extends therebetween; a manifold plate 48 having a first end 50, a second end 52 and an outer periphery 54 that intersects the ends 50, 52 and extends therebetween; a valve plate 56 having a first end 58, a second end 60 and an outer periphery 62 that intersects the ends 58, 60 and extends therebetween; and a port plate 64 having a first end 66, a second end 68 and an outer periphery 70 that intersects the ends 66, 68 and extends therebetween. As shown in the drawings, a selected one of the plates; for example, the manifold plate 48, can be machined from angle stock so that one web of the stock forms the plate and the other web extends from the periphery of the plate to form a convenient bracket 72 for mounting the assembled pump 20 on an apparatus in which the pump 20 might be used.

Figure 13:
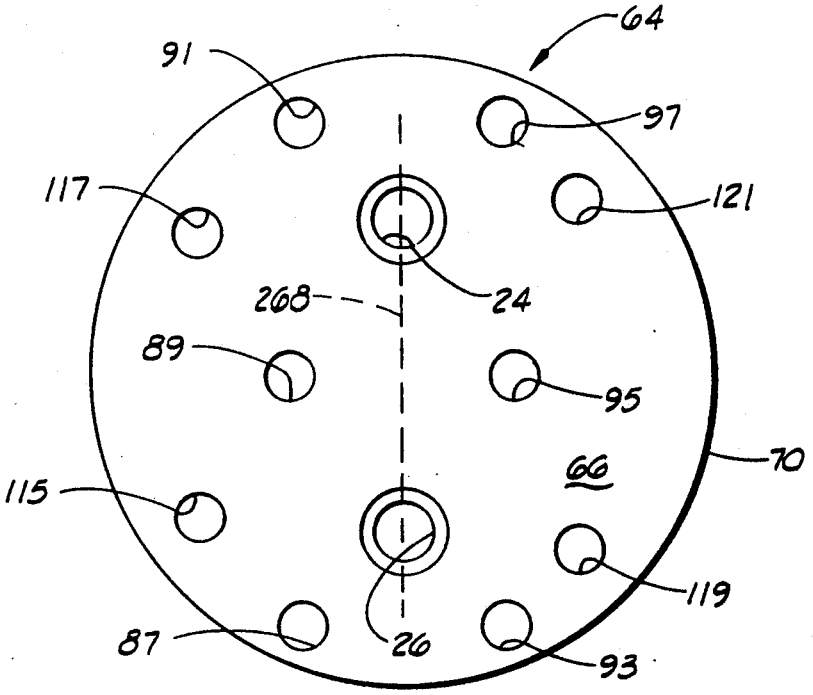
FIG. 13 is a top view of the port plate.
Figure 14:
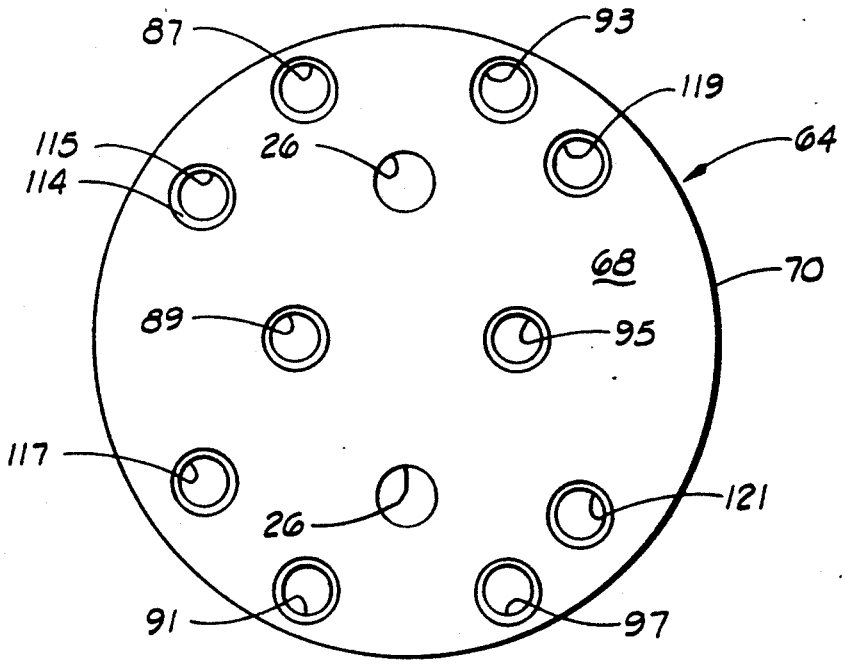
FIG. 14 is a bottom view of the port plate.

Before describing the construction of each of the plates 40, 48, 56 and 64, it will be useful to first describe the assembly of the pump 20 once the plates have been independently manufactured. Referring first to FIG. 2, threaded holes 74, 76, 78, 80, 82, 84 are formed through the manifold plate 48 and aligning, unthreaded holes 75, 77, 79, 81, 83, and 85 (FIG. 10) are formed through the valve plate 56 and unthreaded holes 87, 89, 91, 93, 95, 97 (FIG. 13) through the port plate 70. (For clarity of illustration, the holes 75, 77, 79, 81, 83 and 85 through the valve plate 56 and holes 87, 89, 91, 93, 95 and 97 through the port plate 64 have not been numerically designated in FIG. 2.) Assembly of lower portions of the pump body 22; specifically, the manifold plate 48, the valve plate 56 and the port plate 64, is effected by mating the first end 66 of the port plate 64 with the second end 60 of the valve plate 56, mating the first end 58 of the valve plate 56 with the second end 52 of the manifold plate 48, and passing bolts 86, 88, 90, 92, 94, 96 through the port and valve plates to screw into the holes 74–84 in the manifold plate 48. Similarly, as shown in FIG. 1, threaded holes 98, 100, 102 and 104 are formed through the pump plate 40 to receive bolts 106, 108, 110 and 112 that pass through aligning holes 99, 101, 103, 105 (FIG. 8) through the manifold plate 48, holes 107, 109, 111, and 113 (FIG. 10) through the valve plate 56 and holes 115, 117, 119 and 121 (FIG. 13) through the port plate 64 to complete assembly of the pump body 22. Sealing of the bolt holes to prevent leakage from the pump body 22 can be effected as indicated on the bolts 106, 108, 110 and 112; specifically, as indicated in FIG. 14, the holes 87, 89, 91, 93, 95 and 97 for the bolts 86, 88, 90, 92, 94 and 96 and holes 115, 117, 119 and 121 for the bolts 106, 108, 110 and 112 are countersunk, as shown at 114 for the hole 115, at the second end 68 of the port plate 64 and each of the bolts is provided with an O-ring and washer, numerically designated at 116 and 118 respectively for the bolt 106 in FIG. 1, that fit within countersunk portions of the holes through the port plate 64.

With continuing reference to FIG. 1, a shoulder 120 is formed on the first end 42 of the pump plate 40 to mate with the open lower end of the reservoir member 30 and assembly of the reservoir member 30 to the pump body 22 is effected via bolts 122, 124 that are passed through unthreaded holes 126 and 128 formed through the closed first end of the reservoir member 30 to screw into threaded holes 130 and 132 formed through the pump plate 40. Sealing between the reservoir member 30 and the pump plate 40 is effected by an O-ring 134 that mounts on the shoulder 120 and sealing of the holes that receive the bolts 122, 124 is effected in the same manner that sealing of the holes that receive the bolts through plates of the pump body 22 is effected; that is, by means of washers and O-rings (not numerically designated in the drawings) mounted on the bolts.

A shoulder 136 is formed on the first end 34 of the reservoir member 30 to mate with the open lower end of the case 138 of the motor 36 and the motor 36 is bolted to the reservoir member 30 via bolts 140 and 142 that pass through holes 144 and 146 formed through the motor case 138 to screw into threaded holes 148 and 150 formed in the first end 34 of the reservoir member 30. Sealing between the reservoir member 30 and the motor 36 is effected by an O-ring 152 that mounts on the shoulder 136 and seals about the bolts 140 and 142 is formed by O-ring and washers (not numerically designated in the drawings) in the manner described above.

Before continuing, it will be useful to summarize the assembly of the pump 20. Initially, the manifold, valve and port plates, 48, 56 and 64 respectively, and pump components contained in these plates as will be described below is effected via the bolts 86, 88, 90, 92, 94 and 96 and the pump plate 40 is then secured to the manifold plate 48 via the bolts 106–112. As part of this assembly, O-rings 154, 156 and 158 are placed in grooves 160 (FIG. 11), 162 (FIG. 10) and 164 (FIG. 4) formed in the second end of the valve plate 56, the first end of the valve plate 56 and the second end of the pump plate 48, respectively, to provide seals between the plates of the pump body 22. Thereafter, the reservoir member 30 is mounted on the pump body 22 and bolted thereto. Finally, the shaft 38 of the motor 36 is passed through a bore 166 formed through the upper end of the reservoir member 30 and a rotating seal 168 about such bore and into the pump body 22 to engage the gear assembly 28 as will be discussed below.

It will thus be seen that, as a result of the above-described construction of the pump 20, the interior of the pump body 22; specifically, the ends of the plates 40, 48, 56 and 64, will be accessible to the pump manufacturer for machining operations so that chambers and flow passages to be discussed below can be formed by milling, turning and drilling operations in which chambers are cut into the ends of the plates of which the pump body 22 is comprised and flow passages are formed through such plates. Once these chambers and passages have been formed, the assembly described above will completely seal the pump 20 from the environment so that the pump can be protected from environmental damage by a suitable surface coating applied to the reservoir member and pump body after assembly.

With this introduction, details of the construction of the pump 20 and additional components of which it is comprised may now be considered. Referring first to FIG. 1, the reservoir member 30 can be conveniently constructed from aluminum bar stock by external machining to form the shoulder 136 and internal boring and machining from the second end 32 to form a cavity 170 that will become a reservoir when the reservoir member 30 is mounted atop the pump body 22 as described above. A port for filling the reservoir is formed by a threaded hole (not shown) formed laterally through the wall about such cavity to receive a plug 172. A smaller cavity (not numerically designated in the drawings) is machined into the upper wall 173 of the cavity 170, about the bore 166, to receive the rotating seal 168. Holes described above and used in the assembly of the pump 20 are formed by conventional drilling and tapping operations.

Figure 3:
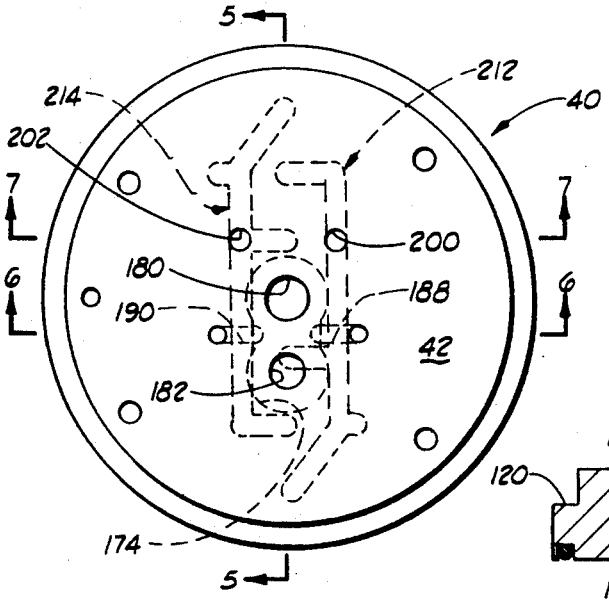
FIG. 3 is a top view of the pump plate of the pump shown in FIG. 1.
Figure 5:
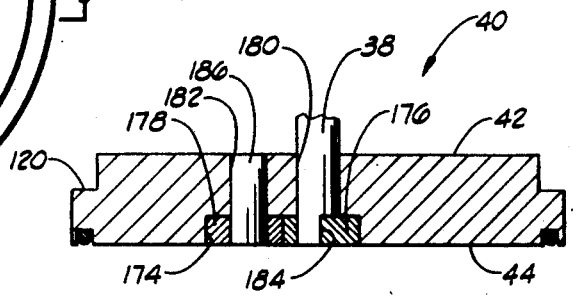
FIG. 5 is a cross section of the pump plate taken along line 5—5 of FIG. 3.
Figure 6:
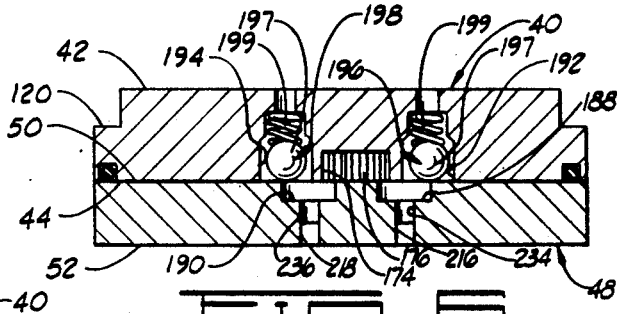
FIG. 6 is a cross section of the pump plate and a manifold plate of the pump shown in FIG. 1 taken along line 6—6 of FIG. 3.
Figure 4:
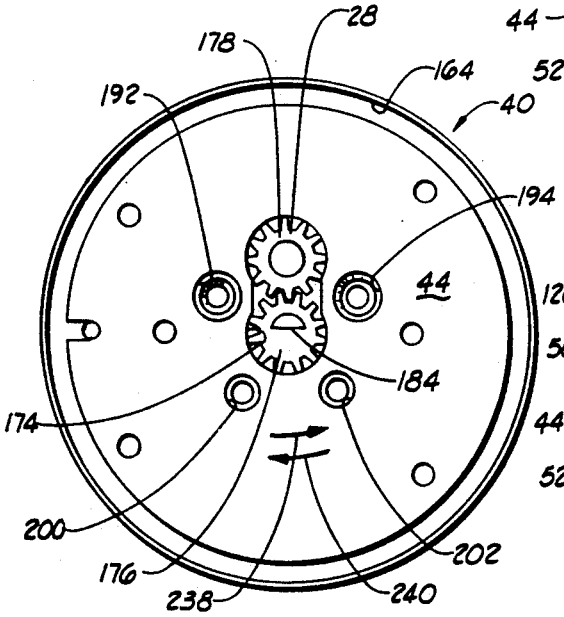
FIG. 4 is a bottom view of the pump plate illustrating the gear assembly of the pump.

The pump plate 40, more particularly shown in FIGS. 3 through 7, can similarly be manufactured from aluminum bar stock using external machining to form the shoulder 120 and milling and drilling to form remaining features of such plate. More particularly, as shown in FIGS. 4 through 6, a body portion 174 of a pumping chamber (not generally designated in the drawings) is milled into the second end 44 of the pump plate 40 to receive meshing gears 176 and 178 of which the gear assembly 28 is comprised. The body portion 174 of the pumping chamber has the general form of two interlocking circular cavities, one centered on a bore 180 that is drilled through the pump plate 40 to align with the axis of the motor 36 in the assembled pump and the other centered on a bore 182 offset from the bore 180. In the assembly of the pump 20, the motor shaft 38 is extended through the bore 180 and has a flat 184 formed on one side thereof to engage a semicircular bore formed through the gear 176 so that the gear 176 can be rotated in either direction on the shaft 38. The gear 178 is mounted on a pin 186 supported in the bore 182. The lower end of the body portion 174 of the pumping chamber, at the second end 44 of the pump plate 40, is closed by the first end 50 of the manifold plate 48 when the pump body 22 is assembled and, as shown in FIGS. 6 and 8, first and second inlet-outlet portions, 188 and 190, of the pump chamber are milled into the first end 50 of the manifold plate 48 to underlie opposite sides of the body portion 174 of the pumping chamber. Such relationship between the portions of the pumping chamber have been shown in dashed line in FIG. 3 for a purpose that will become clear below.

As shown in FIG. 6, fluid make-up passages 192 and 194 are bored through the pump plate 40 in alignment with portions of the inlet-outlet portions 188 and 190 respectively to fluidly communicate the pumping chamber with the reservoir member cavity 170 in the assembled pump 20. Each of the passages 192 and 194 contains a fluid make-up valve, 196 for the passage 192 and 198 for the passage 194, that will open to permit fluid to flow into the pumping chamber from the reservoir but will close in response to fluid pressure in an inlet-outlet portion of the pumping chamber to prevent fluid flow through the passages 192 and 194 from the pumping chamber to the reservoir formed in the reservoir member 30. More specifically, each make-up valve is comprised of a ball 197 that is driven by fluid pressure in the inlet-outlet portion of the pumping chamber against a seat (not numerically designated in the drawings) formed in the passage wherein the ball 197 is located and a spring 199 that displaces the ball 197 from the seat in the absence of such pressure.

Figure 7:
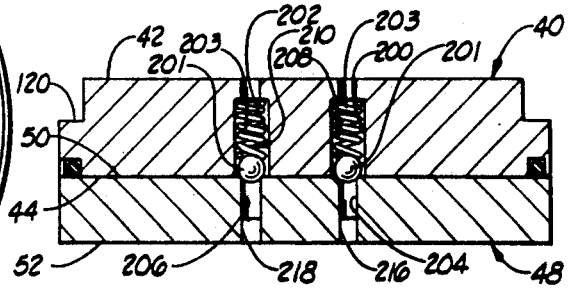
FIG. 7 is a cross section of the pump and manifold plates taken along line 7—7 of FIG. 3.
Figure 8:
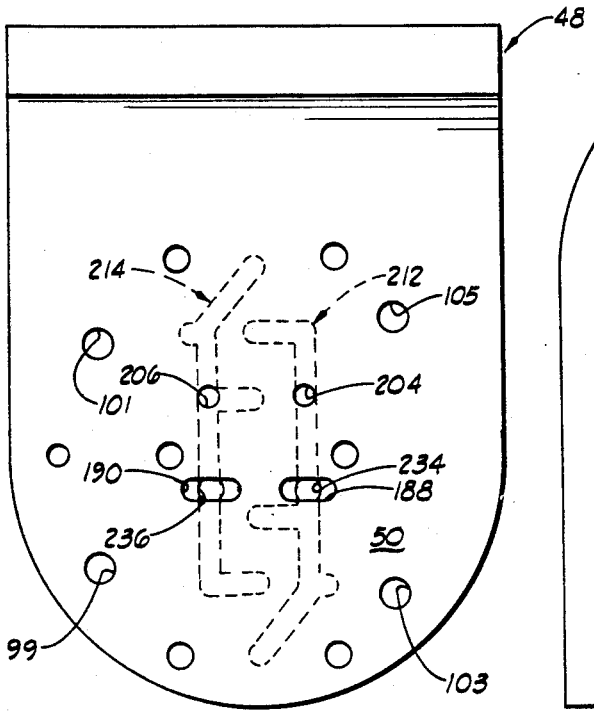
FIG. 8 is a top view of the manifold plate.

Referring to FIG. 7, relief passages 200 and 202 are formed through the pump plate 40 to align with passages 204 and 206 formed through the manifold plate 48. The passages 200 and 202 contain conventional pressure relief valves 208 and 210 respectively, each comprised of a ball 201, the balls 201 being driven partially into the passages 204, 206 through the manifold plate 48 by springs 203. The valves 208, 210 open at a preselected pressure in the passages 204 and 206 to discharge hydraulic fluid to the reservoir formed in the reservoir member 30 for a reason that will become clear below.

Figure 9:
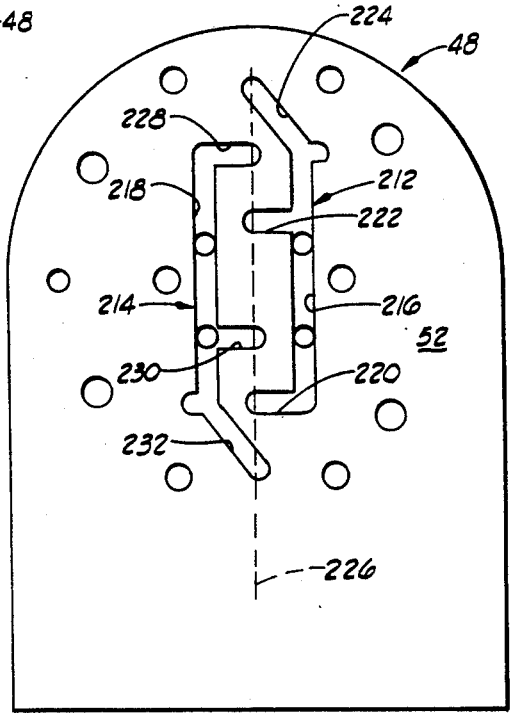
FIG. 9 is a bottom view of the manifold plate.

With continuing reference to FIGS. 6 and 7 and with additional reference to FIGS. 8 and 9, first and second fluid distribution chambers 212 and 214 are formed in the pump body 22 by milling channels in the second end 52 of the manifold plate 48 as specifically shown in FIG. 9, such channels being closed to become chambers by abutment of the first end 58 of the valve plate 56 with the second end 52 of the manifold plate 48 when the pump body 22 is assembled. As shown in FIG. 9, each chamber 212, 214 so formed has an elongated body portion, 216 for the chamber 212 and 218 for the chamber 214, and the body portions 216, 218 extend parallel to each other across the second end of the manifold plate 48. Lateral extensions 220, 222 and 224 are formed from the body portion 216 of the first fluid distribution chamber 214, the extensions 220, 222 and 224 terminating along a centerline 226 of the manifold plate 48 between the body portions 216 and 218 of the fluid distribution chambers 212 and 214 respectively. Similar lateral extensions 228, 230 and 232 are formed from the body portion 218 of the fluid distribution chamber 214.

The chambers 212 and 214 have been superimposed in dashed line on the first end 42 of the pump plate 40 in FIG. 3 and on the first end 50 of the manifold plate 48 in FIG. 8 to illustrate fluid communication between the reservoir, the pumping chamber and the fluid distribution chambers when the pump 20 is assembled and it will be useful to consider this communication before continuing with the description of remaining portions of the pump body 22. As shown in FIGS. 3 and 6, the body portion 216 of the first fluid distribution chamber 212 underlies the inlet-outlet portion 188 of the pump chamber so that fluid communication between the first fluid distribution chamber 212 and one side of the pumping chamber can be established by a passage 234 (see also FIG. 8) drilled through the manifold plate 48 to intersect the inlet-outlet portion 188 of the pumping chamber and the body portion 216 of the first fluid distribution chamber. Similarly, the body portion 218 of the second fluid distribution chamber underlies the inlet-outlet portion 190 of the pumping chamber to establish fluid communication between the opposite side of the pumping chamber and the second fluid distribution chamber 214 via a passage 236 drilled through the manifold plate to intersect the inlet-outlet portion 190 of the pumping chamber and the body portion 218 of the second fluid distribution chamber. As noted above, the motor 36 that drives the gears 176 and 178 is reversible. Thus, the gears can be turned by operating the motor 36 to turn the gear 176 in a direction 238 in FIG. 4 to draw hydraulic fluid from the second fluid distribution chamber 214 and discharge such fluid into the first fluid distribution chamber 212. Alternatively, the motor 36 can be operated to turn the gear 176 in a direction 240 to draw hydraulic fluid from the first fluid distribution chamber 212 and discharge such fluid into the second fluid distribution chamber 214. Further, as shown in FIGS. 3 and 7, the passage 200 formed through the pump plate 40 and containing the pressure relief valve 208 and the passage 204 formed through the manifold plate 48 are aligned with the body portion 216 of the first fluid distribution chamber 212 so that the pressure relief valve 208 serves to limit the pressure in the first fluid distribution chamber 212. Similarly, the passage 202 formed through the pump plate 40 and containing the pressure relief valve 210 and the passage 206 formed through the manifold plate 48 are aligned with the body portion 218 of the second fluid distribution chamber 214 so that the pressure relief valve 210 serves to limit the pressure in the second fluid distribution chamber 214. The purpose of such limitation will become clear from the description of the operation of the pump 20 to be discussed below.

Figure 10:
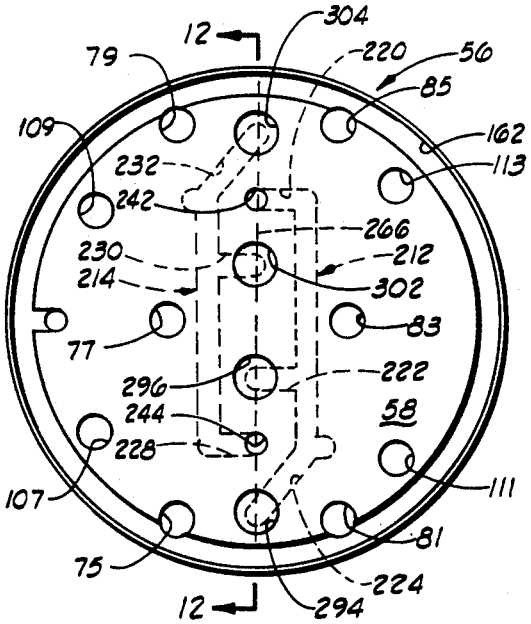
FIG. 10 is a top view of the valve plate of the pump shown in FIG. 1
Figure 11:
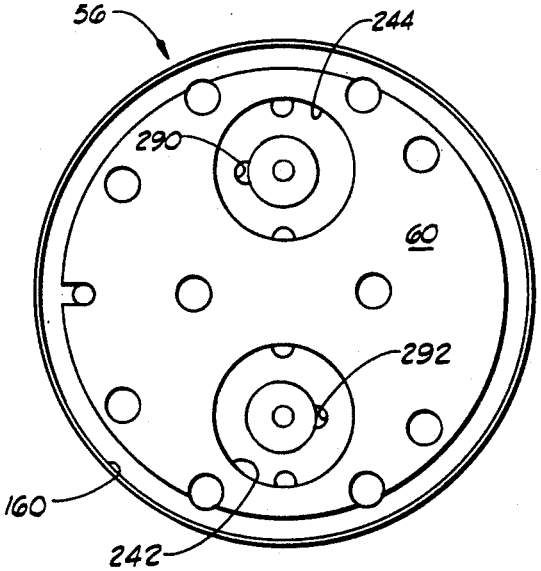
FIG. 11 is a bottom view of the valve plate.
Figure 12:
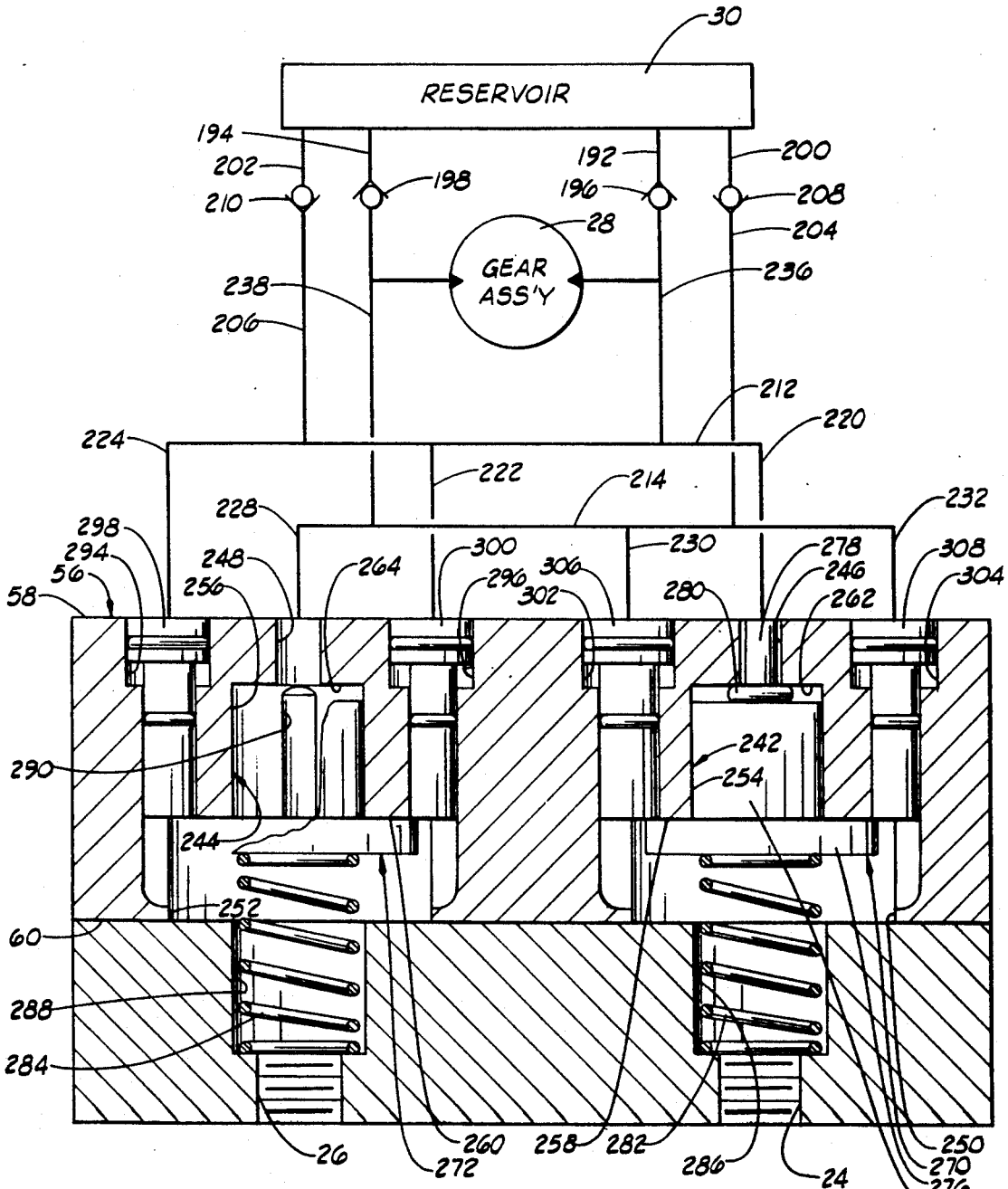
FIG. 12 is a cross section of the valve plate and a port plate of the pump shown in FIG. 1 taken along line 12—12 of FIG. 10 and illustrating the main pump valves in partial cutaway together with a schematic of the hydraulic circuit of the pump.

Referring now to FIGS. 10, 11 and 12, the valve plate 56 has a first main valve passage 242 and a second main valve passage 244 formed therethrough to intersect the first and second ends, 58 and 60 respectively, of the valve plate 56. As particularly shown in FIG. 12, each of these passages is bored to have: a small diameter portion, 246 for the passage 242 and 248 for the passage 244, intersecting the first end 58 of the valve plate 56; a large diameter portion, 250 for the passage 242 and 252 for the passage 244, intersecting the second end 60 of the valve plate 56; and an intermediate diameter portion, 254 for the passage 242 and 256 for the passage 244, between the large and small diameter portions. Shoulders 258 and 260 are formed between the large and intermediate diameter portions of the passages 242 and 244 respectively to form primary valve seats, and shoulders 262 and 264 are similarly formed between the intermediate and small diameter portions of the passages 242 and 244 respectively to form secondary valve seats that close the valve body to fluid flow at such times that the motor 36 is not operating in a manner to be discussed below.

The passages 242 and 244 provide interruptible fluid communication between the fluid distribution chambers 212 and 214 and the ports 24 and 26 respectively. To this end, and as shown in FIG. 10 wherein the fluid distribution chambers have been drawn in dashed line on the first end of the valve plate 56, the intersections of the passages 242 and 244 with the first end of the valve plate 56 lie along a line 266 that coincides with the centerline 226 of the manifold plate (FIG. 9) in the assembled pump body 22 and the passage 242 is aligned with the extension 220 of the fluid distribution chamber 212 while the extension 228 of the second fluid distribution chamber 214 is aligned with the passage 244. The centers of the ports 24 and 26 are similarly disposed along a line 268 (FIG. 13) that parallels the centerline 226 and the centers thereof are spaced a distance equal to the spacing of the centers of the passages 242, 244 so that, as shown in FIG. 12, the first port 24 is coaxial with the first main valve passage 242 and the second port 26 is coaxial with the second main valve passage 244 in the assembled pump body 22.

Control of the delivery and return of fluid from and to the pump body 22 is effected by a valve assembly (not generally designated in the drawings) comprised of a first main pump valve 270 located in the first main pump valve passage 242 and second main valve 272 located in the main valve passage 244. As shown for the first main pump valve 270, each of the main pump valves 270, 272 is comprised of a central body portion 274 that is located in the intermediate diameter portion 254 or 256 of the passage 242 or 244 that contains the valve 270 or 272. A flange 276 is formed on the end of the body portion 274 of each valve 270, 272 to engage, for the valve 270, the primary valve seat 258 and, for the valve 272, the primary valve seat 260 in a sealing position shown for the valves 270, 272 wherein the valves are driven to their maximal extent within the passages 242 and 244 toward the first end 58 of the valve plate 56, On the opposite end of the body portion 274 of each valve 270, 272, an axial extension 278 (for clarity of illustration, the axial extension 278 for the valve 272 has not been illustrated in the drawings) is formed to extend into the small diameter portions 246, 248 of the valve passages 242, 244 wherein the valve is located. As shown for the valve 270, an O-ring 280 is mounted on the axial extension 278 of each of the valves 270, 272 to engage the secondary seat 262 or 264 of the passage 242 or 244 wherein the valve is the located when the valves are in the sealing position thereof shown in FIG. 12. Springs 282 and 284 are mounted in enlarged portions 286, 288 of the ports 24 and 26 respectively and engage the valves 270 and 272 in the assembled pump 20 to bias the valves to ward the sealing positions thereof.

With the pump 20 constructed as has so far been described, the ports 24 and 26 will neither deliver nor receive hydraulic fluid from a device, such as a hydraulic actuating cylinder, attached to the ports 24, 26. Instead, the valves 270 and 272 provide a positive seal against fluid flow from such device that serves as a safety feature of the invention. For example, should the pump be used with the outboard motor mounting apparatus described in the aforementioned U.S. 4,482,330 to Cook and should the first port 24 be connected to the end of the hydraulic actuating cylinder in such apparatus that receives pressurized hydraulic fluid to raise the outboard motor, the weight of the motor and motor bracket on which it is mounted will tend to drop the motor at such times that the pump is turned off. However, such tendency will give rise to a hydraulic pressure in the first port 24 that will drive the valve 270 firmly against the seats 258 and 262 to capture hydraulic fluid in one end of the hydraulic actuating cylinder and provide a positive lock against any movement of the motor on the transom of the boat. Indeed, any tendency to move of a device that is positioned by hydraulic fluid from the pump 20 will cause one of the valves 270, 272 to be more firmly seated in the sealing position thereof in one of the main valve passages to cause a positive lock against such movement.

As will be discussed below with respect to the operation of the pump, fluid flow between the fluid distribution chambers and the ports is effected by displacing the valves 270, 272 away from the sealing positions thereof and grooves 290 and 292 (FIGS. 11 and 12) are formed in the walls of the intermediate portions 254, 256 of the passages 242, 244 to enable fluid to flow about the valves 270, 272. Specifically, fluid flows about the extensions 278 of the valves 270, 272, through the grooves 290, 292, over the upper sides of the flange 276 and between the flanges and the walls of the enlarged portions 250, 252 of the passages 242, 244.

With continuing reference to FIG. 12 and with further reference to FIG. 10, two first piston chambers 294 and 296 are formed in the first end 58 of the valve plate 56 to extend thereinto and intersect the enlarged portion 252 of the second main valve passage 244. As can be seen in FIG. 10, wherein the fluid distribution chambers 212 and 214 have been superimposed on the first end of the valve plate in dashed lines, the first piston chambers 294 and 296 are overlain by the extensions 224 and 222 respectively of the first fluid distribution chamber 212 so that fluid pressure in such chamber at such times that the pump 20 is operated to transfer fluid from the second fluid distribution chamber to the first fluid distribution chamber is transmitted to the first piston chambers 294, 296. First pistons 298 and 300, slidably mounted in the first piston chambers 294 and 296 respectively and having conventional O-ring seals (not numerically designated in the drawings) to prevent fluid flow through the first piston chambers, extend to and engage the flange 276 of the second main pump valve 272 and the pistons 298 and 300 respond to pressure in the first fluid distribution chamber 212 to exert a force on the second main pump valve 272 for a purpose to be discussed below. Two second piston chambers 302 and 304 are similarly formed in the first end 58 of the valve plate 56 to underlie the extensions 230, 232 of the second fluid distribution chamber 214 and the second pistons chambers 302, 304 similarly contain second pistons 306 and 308 that are slidably mounted in the chambers 302, 304 to engage the portion 276 of the first main pump valve 270.

OPERATION OF THE PUMP

In order to discuss the operation of the pump 20, a schematic representation of portions of the hydraulic circuit of the pump 20 has been added to FIG. 12 and such portions of the circuit have been drawn in relation to the valves 270, 272 and pistons 298, 300, 306, and 308 mounted in the valve plate 56. Features of the representation have been indicated using numerical designations of the features of the pump that have been described above; specifically, the fluid distribution chambers 212 and 214 have been represented by horizontal lines so designated in FIG. 12 with the extensions 220, 222, 224, 228, 230 and 232 from the body portions of the first fluid distribution chambers being represented as vertical lines to the main valve passage bores and the piston chambers. Similarly, passages formed through the manifold and pump plates have been represented by lines bearing the numerical designations of such passages in FIGS. 6 and 7, the gear assembly 28 and valves 196, 198, 208 and 210 have been represented by common hydraulic symbols bearing the numerically designations of such components in FIGS. 4, 6 and 7 and the reservoir formed by the reservoir member 30 as described above has been indicated as a block bearing the numerical designation 30.

As has been discussed above, at such times that the motor 36 is not operating, the springs 282 and 284 bias the main pump valves 270, 272 into the sealing position in the main pump valve passages 242 and 244 so that return of fluid to the pump 20 cannot occur. Specifically, fluid pressure in the ports 24 and 26 tending to establish a return flow to the pump 20 will drive the valves 270 and 272 more firmly against seats formed in the passages 242, 244 to provide a positive lock against any return of fluid to the pump 20 in a nonoperating condition of the pump 20.

To establish fluid flow from and to the pump 20, it is necessary only to commence operation of the motor 36 and, moreover, the direction of flow at the ports 24, 26 is determined by the direction of rotation of the shaft 38 of the motor 36. More specifically, if the motor shaft 38 is rotated in the direction 238 shown in FIG. 4, hydraulic fluid will be drawn from the second fluid distribution chamber 214 and delivered to the first fluid distribution chamber 212 to build up hydraulic pressure in the chamber 212. As can be seen in FIG. 12, such pressure is transmitted by the chamber extension 220 to the first main valve passage 242 to force the first main pump valve 270 away from the sealing position thereof and establish fluid communication from the first fluid distribution chamber 212 to the first port 24 for delivery of hydraulic fluid from the port 24. Moreover, the extensions 222 and 224 of the first fluid distribution chamber 212 will transmit pressure in the chamber 212 to the first pistons 298 and 300 that, as shown in FIG. 12, bear against the second main pump valve 272. Thus, the pressure in the first fluid distribution chamber exerts a force on the second main pump valve 272 to force the second main pump valve away from the sealing position thereof. Thus, the second main valve passage 244 is opened to fluid flow for the return of fluid via the second port 26 to the second fluid distribution chamber 21 and thence to the gear assembly 28. Thus, operation of the motor 36 to turn the shaft 38 thereof in the direction 238 establishes a fluid circulation in which hydraulic fluid is drawn from a device connected to the ports 24, 26 via the port 26 and transmitted back to the device via the port 24.

If the motor shaft 38 is turned in the reverse direction, i.e., the direction 240 in FIG. 4, the reverse result is obtained. In this case, fluid is drawn from the first fluid distribution chamber 212 and delivered to the second fluid distribution chamber 214 to build up pressure therein that will directly force the second main pump valve 272 away from the sealing position thereof while forcing the first main pump valve 270 away from its sealing position via pressure exerted against the second pistons 306 and 308. Thus, again a fluid circulation is established between the pump 20 and a device connected to the ports 24 and 26; however, such circulation will draw hydraulic fluid from the side of the device connected to the first port 24 and deliver fluid to the side of the device connected to the second port 26.

It will be noted that the above-described operation of the pump 20 is self-regulating. Should the pressure in one fluid distribution chamber be insufficient to cause the pistons fluidly communicated therewith to force the main pump valve in the main pump valve passage communicated with the other fluid distribution chamber away from its sealing position, flow from the pump 20 will cease to cause fluid pressure in the fluid distribution chamber which is receiving fluid from the gear assembly 28 to increase indefinitely. Thus, at some point, the main pump valve in the return main valve passage must, at some point, be forced from its sealing position to establish the above described fluid circulation.

The present invention also contemplates that the pump 20 will, at times, be used with a single-ended hydraulic actuating cylinder; that is, a hydraulic actuating cylinder in which the piston rod extends from the piston of the cylinder through only one end portion of the cylinder. In this case, the quantity of fluid that must be received at one side of the hydraulic actuating cylinder to effect a movement of the piston rod thereof will differ from the quantity that is driven from the other side. In the case in which delivery must exceed return and delivery is from the first port 24 via the first fluid distribution chamber 212 so that the pressure in the second fluid distribution chamber is, in effect, negative, the make-up valve 198 to the second fluid distribution chamber will open to provide additional fluid to the intake side of the gear assembly 28 to make up the difference. Similarly, should a larger delivery of fluid be required from the second port 26 than is drawn from the first port 24, the difference is supplied from the reservoir 30 via the make-up valve 196.

Finally, should fluid flow from the pump 20 be externally blocked for any reason, pressure in the high pressure fluid distribution chamber 212, 214 will force the relief valve 208 or 210 from such chamber to the reservoir to open and thereby shunt hydraulic fluid from the gear assembly 26 to the reservoir member 30 to prevent damage to the pump 20.

It will be clear that the present invention is well adapted to carry out the objects and attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

What is claimed is:

1. A hydraulic pump, comprising:

a pump body wherein are formed first and second ports for delivery of hydraulic fluid from one port and return of hydraulic fluid to the other port, first and second fluid distribution chambers, and first and second main valve passages, the first main valve passage fluidly communicating the first fluid distribution chamber with the first port and the second main valve passage fluidly communicating the second fluid distribution chamber with the second port;

pumping means in the pump body operable for drawing hydraulic fluid from one fluid distribution chamber and discharging hydraulic fluid to the other fluid distribution chamber;

a first main pump valve disposed in the first main valve passage for movement to a sealing position wherein the first main pump valve seals the first main valve passage against fluid flow:

means for biasing the first main valve toward the sealing position thereof;

a second main pump valve disposed in the second main valve passage for movement to a sealing position wherein the first second pump valve seals the second main valve passage against fluid flow:

means for biasing the second main valve toward the sealing position thereof;

means fluidly communicated with the first fluid distribution chamber and responsive to fluid pressure therein for forcing the second main pump valve away from the sealing position thereof at such times that the pumping means is operated to draw hydraulic fluid from the second fluid distribution chamber and discharge hydraulic fluid into the first fluid distribution chamber; and means fluidly communicated with the second fluid distribution chamber and responsive to fluid pressure therein for forcing the first main pump valve away from the sealing position thereof at such times that the pumping means is operated to draw hydraulic fluid from the first fluid distribution chamber and discharge hydraulic fluid into the second fluid distribution chamber.

2. The pump of claim 1 wherein the pump body is further characterized as having formed therein a first piston chamber, fluidly communicating at one end thereof with the second fluid distribution chamber and intersecting the first main valve passage at the other end thereof, and a second piston chamber, fluidly communicating at one end thereof with the first fluid distribution chamber and intersecting the second main valve passage at the other end thereof; wherein the means for forcing the first main pump valve away from the sealing position thereof comprises a piston disposed in the first piston chamber to engage the first main pump valve; and wherein the means for forcing the second main pump valve away from the sealing position thereof comprises a piston disposed in the second piston chamber to engage the second main pump valve.

3. The pump of claim 2 further comprising:

means mounted on the pump body for forming a hydraulic fluid reservoir;

make-up means for supplying hydraulic fluid from the reservoir to the pumping means whereby hydraulic fluid can be delivered from the pump body at a rate greater than the rate of return of hydraulic fluid to the pump body; and relief means for partially discharging hydraulic fluid delivered to the fluid distribution chambers to the reservoir whereby hydraulic fluid can be delivered from the pump body at a rate smaller that the rate of return of hydraulic fluid to the pump body.

4. The pump of claim 1 further comprising:

means mounted on the pump body for forming a hydraulic fluid reservoir;

make-up means for supplying hydraulic fluid from the reservoir to the pumping means whereby hydraulic fluid can be delivered from the pump body at a rate greater than the rate of return of hydraulic fluid to the pump body; and relief means for partially discharging hydraulic fluid delivered to the fluid distribution chambers to the reservoir whereby hydraulic fluid can be delivered from the pump body at a rate smaller that the rate of return of hydraulic fluid to the pump body.

5. In a hydraulic pump of the type including a pump body wherein are formed first and second ports for delivering fluid from the pump from one of the first and second ports and receiving fluid returned to the pump at the other of the first and second ports, a plurality of chambers and passages containing pumping means for selectively forcing fluid into the first port while receiving fluid form the second port and alternatively forcing fluid into the first port while receiving fluid from the first port, and fluid control means for controlling the flow of fluid between the pumping means and the ports, the improvement wherein the pump body is comprised of a plurality of plates, each characterized as having a first end and an opposite second end, wherein said plates are connected end to end to form the pump body, wherein the chambers are formed in the ends of the plates, and wherein the ports and flow passages are formed through the plates to intersect the ends thereof.

6. The pump of claim 5 wherein the pump body is further characterized as comprising:

a pump plate having a pumping chamber formed at least partially in the second end thereof;

a manifold plate wherein the first end of the manifold plate abuts the second end of the pump plate in the assembled pump body and wherein first and second fluid distribution chambers fluidly communicated with opposite sides of the pumping chamber are formed in the second end of the manifold plate;

a valve plate, wherein the first end of the valve plate abuts the second end of the manifold plate in the assembled valve body, wherein the passages formed in the pump body include a first main valve passage formed through the valve plate to communicate at one end thereof with the first fluid distribution chamber and at the opposite end thereof with the first port and a second main valve passage formed through the valve plate to communicate at one end thereof with the second fluid distribution chamber and at the opposite end thereof with the second port, wherein at least one first piston chamber is formed in the first surface of the valve plate to fluidly communicate with the second fluid distribution chamber and extend into the valve plate to intersect the first main valve passage, and wherein at least one second piston chamber is formed in the first surface of the valve plate to fluidly communicate with the second fluid distribution chamber and extend into the valve plate to intersect the second main valve passage; and a port plate, wherein the first end of the port plate abuts the second end of the valve plate in the assembled pump body and wherein the first and second ports are formed through the port plate; and wherein the fluid control means comprises:

a first main pump valve disposed in the first main valve passage for movement toward the manifold plate to a sealing position wherein the first main pump valve seals the first main valve passage against fluid flow;

means for biasing the first main pump valve toward the sealing position thereof;

a second main pump valve disposed in the second main valve passage for movement toward the manifold plate to a sealing position wherein the second main pump valve seals the second main valve passage against fluid flow;

means for biasing the second main pump valve toward the sealing position thereof;

at least one first piston, wherein each first piston is disposed in a first piston chamber and is slidable therein to engage the first main pump valve; and at least one second piston, wherein each second piston is disposed in a second piston chamber and is slidable therein to engage the second main pump valve.

7. The pump of claim 6 further comprising a reservoir member having a closed first end and an open second end, wherein the second end of the reservoir member is mated with the first end of the pump plate to form therewith a fluid reservoir adjacent the first end of the pump plate, wherein the passages formed in the pump body include a first make-up passage formed through the pump plate to fluidly communicate the reservoir with one side of the pumping chamber, a second make-up passage formed through the pump plate to fluidly communicate the reservoir with the opposite side of the pumping chamber, a first relief passage formed partially through the pump plate and partially through the manifold plate to fluidly communicate the reservoir with the first fluid distribution chamber and a second relief passage formed partially through the pump plate and partially through the manifold plate to fluidly communicate the reservoir with the second fluid distribution chamber, and wherein the fluid control means further comprises:

a make-up check valve in each of the make-up passages, wherein each make-up check valve is biased to provide fluid flow from the reservoir to the pumping chamber while preventing fluid flow from the pumping chamber to the reservoir; and a relief valve in each of the relief passages, wherein each relief valve is biased to normally close the relief passage in which the relief valve is disposed and to open such passage to fluid flow in response to a preselected pressure in the fluid distribution chamber with which such relief passage communicates.

* * * * *